US006037009A

United States Patent [19]

Clare et al.

[11] Patent Number: 6,037,009

[45] Date of Patent: Mar. 14, 2000

[54] METHOD FOR SPRAYING ADHESIVE

[75] Inventors: Timothy Patrick Clare, Appleton; William Richard Kollitz, Oshkosh; Matthew John Mikula, Appleton, all of Wis.

[73] Assignee: Kimberly-Clark Worldwide, Inc., Neenah, Wis.

[21] Appl. No.: 08/422,115

[22] Filed: Apr. 14, 1995

[51] Int. Cl.[7] ..... B05D 1/02

[52] U.S. Cl. ..... 427/421; 427/424; 427/286; 427/288

[58] Field of Search ..... 427/421, 424, 427/286, 288; 604/378, 366, 386

[56] References Cited

U.S. PATENT DOCUMENTS

| | | |
|---|---|---|
| Re. 33,481 | 12/1990 | Ziecker et al. . |
| 2,672,844 | 3/1954 | Flint . |
| 2,706,520 | 4/1955 | Chandler . |
| 3,061,198 | 10/1962 | Kerr et al. . |
| 3,081,947 | 3/1963 | Walter . |
| 3,219,276 | 11/1965 | Norris . |

(List continued on next page.)

FOREIGN PATENT DOCUMENTS

| | | |
|---|---|---|
| 1057457 | 7/1979 | Canada . |
| 1058125 | 7/1979 | Canada . |
| 1063918 | 10/1979 | Canada . |
| 1065554 | 11/1979 | Canada . |
| 1287700 | 8/1981 | Canada . |
| 1111630 | 11/1981 | Canada . |
| 1148701 | 6/1983 | Canada . |
| 1153152 | 9/1983 | Canada . |
| 1157641 | 11/1983 | Canada . |
| 1175602 | 10/1984 | Canada . |
| 1177633 | 11/1984 | Canada . |
| 1182601 | 2/1985 | Canada . |
| 1183306 | 3/1985 | Canada . |
| 1207104 | 7/1986 | Canada . |
| 1245001 | 11/1988 | Canada . |
| 1247803 | 1/1989 | Canada . |
| 1274052 | 9/1990 | Canada . |
| 2013182 | 10/1990 | Canada . |
| 2013905 | 10/1990 | Canada . |
| 1275896 | 11/1990 | Canada . |
| 1277577 | 12/1990 | Canada . |
| 2058421 | 2/1991 | Canada . |
| 1286854 | 7/1991 | Canada . |
| 1288200 | 9/1991 | Canada . |
| 1290502 | 10/1991 | Canada . |
| 1291325 | 10/1991 | Canada . |
| 1294390 | 1/1992 | Canada . |
| 1296489 | 3/1992 | Canada . |
| 1122509 | 4/1992 | Canada . |
| 1298934 | 4/1992 | Canada . |
| 1299477 | 4/1992 | Canada . |
| 0111618 | 6/1984 | European Pat. Off. . |
| 0380781 | 8/1990 | European Pat. Off. . |
| 3325126C1 | 1/1985 | Germany . |
| 1575140 | 9/1980 | United Kingdom . |
| 2143320 | 2/1985 | United Kingdom . |
| WO8402190 | 6/1984 | WIPO . |

OTHER PUBLICATIONS

U.S. Patent application Ser. # 07/991,780; Robert L. Popp et al.; Apparatus and Methods for Selectively Controlling a Spray of Liquid to Form a Distinct Pattern.

*Primary Examiner*—Shrive Beck
*Assistant Examiner*—Bret Chen
*Attorney, Agent, or Firm*—Jeffrey B. Curtin

[57] ABSTRACT

Apparatus and methods are disclosed for spraying an adhesive in a selected pattern on a continuously moving web. The method includes the steps of: (a) supplying a predetermined volumetric flow of adhesive to a nozzle; (b) selectively operating the nozzle between an off position and an on position to spray the volumetric flow of the adhesive; (c) diverting the volumetric flow of the adhesive from the nozzle when the nozzle is operated in the off position; and (d) maintaining a back pressure at the nozzle when the nozzle is operated in the off position to provide a substantially instantaneous spray of the adhesive when the nozzle is operated from the off position to the on position.

14 Claims, 4 Drawing Sheets

U.S. PATENT DOCUMENTS 3,402,695 9/1968 Baker et al. .
3,452,710 7/1969 Hentschel .
3,584,571 6/1971 Schmoll .
3,608,793 9/1971 VanLobenSels .
3,628,727 12/1971 Gjerde .
3,661,679 5/1972 Law .
4,058,991 11/1977 McCollough .
4,170,883 10/1979 Varner .
4,237,539 12/1980 Piovoso et al. .
4,239,578 12/1980 Gore .
4,264,957 4/1981 Pautzke .
4,353,326 10/1982 Kolibas .
4,370,944 2/1983 Nagata et al. .
4,456,374 6/1984 Langberg .
4,490,618 12/1984 Cielo .
4,528,630 7/1985 Sargent .
4,530,862 7/1985 Kerzel ..... 427/445
4,532,596 7/1985 Pugsley .
4,603,976 8/1986 Fetzer et al. .
4,608,115 8/1986 Schroth et al. .
4,644,140 2/1987 Hillinger .
4,680,205 7/1987 Lerner et al. .
4,687,137 8/1987 Boger et al. ..... 239/124
4,701,239 10/1987 Craig .
4,711,683 12/1987 Merkatoris .
4,719,575 1/1988 Gnuechtel .
4,721,252 1/1988 Colton .
4,757,930 7/1988 Ditto .
4,762,582 8/1988 de Jonckheere .
4,764,234 8/1988 Smits et al. .
4,764,242 8/1988 Gressick et al. .
4,769,650 9/1988 Peng et al. .
4,774,109 9/1988 Hadzimihalis et al. .
4,778,458 10/1988 Gronostajski .
4,792,817 12/1988 Barney .
4,795,451 1/1989 Buckley .
4,795,510 1/1989 Wittrock et al. .
4,797,687 1/1989 Holder et al. .
4,815,660 3/1989 Boger .
4,829,793 5/1989 Holder et al. .
4,841,307 6/1989 Graham .
4,849,768 7/1989 Graham .
4,872,417 10/1989 Kuwabara et al. .
4,891,249 1/1990 McIntyre .
4,909,879 3/1990 Ball .
4,911,948 3/1990 McIntyre .
4,955,265 9/1990 Nakagawa et al. .
4,969,602 11/1990 Scholl .
4,979,380 12/1990 Robbins et al. .
4,983,109 1/1991 Miller et al. .
4,989,792 2/1991 Claassen .
4,995,333 2/1991 Keller et al. .
4,996,091 2/1991 McIntyre .
5,020,723 6/1991 Crist .
5,030,303 7/1991 Cucuzza .
5,033,143 7/1991 Love, III .
5,065,943 11/1991 Boger et al. .
5,088,443 2/1992 Hastings et al. .
5,124,111 6/1992 Keller et al. .
5,136,520 8/1992 Cox .
5,328,512 7/1994 Steelman et al. .
5,360,629 11/1994 Milbourn et al. ..... 118/410
5,397,054 3/1995 Ziegs .
5,458,684 10/1995 Miller et al. ..... 118/602
5,480,488 1/1996 Bittner et al. .

METHOD FOR SPRAYING ADHESIVE

BACKGROUND OF THE INVENTION

1. Field of the Invention

The present invention relates to an apparatus and method for spraying adhesive in a selected pattern on a continuously moving web. The invention more particularly relates to an apparatus and method for accurately spraying a predetermined volumetric flow of adhesive on a continuously moving web in a selected pattern.

2. Description of the Related Art

Absorbent articles, such as disposable diapers, training pants, adult incontinence articles and the like, generally include several different components which are adhesively bonded together. For example, adhesive has been used to bond individual layers of the absorbent article, such as the outer cover and bodyside liner, together. Adhesive has also been used to bond discrete pieces, such as the fasteners and leg elastics, to the article. Typically, the adhesive has been sprayed or slot-coated on the continuous moving web which provides the absorbent articles. The sufficiency of the adhesive bond between the components of the absorbent article is generally dependent upon the amount of adhesive, the type of adhesive and the spray pattern of the adhesive.

Various techniques for spraying an adhesive on a moving web are well known to those skilled in the art. Many conventional techniques have relied upon pressure to deliver the adhesive to a plurality of nozzles and spray the adhesive from the nozzles on to a moving web. In such conventional techniques, the amount and pattern of the spray of adhesive is directly dependent upon the pressure at each nozzle which can vary depending upon many factors including the pressure at which the adhesive is supplied at, the pressure losses within the system, the number of nozzles which are operating at a given point in time and whether the nozzles are obstructed in any manner. For example, one or more nozzles have frequently become either partially or totally blocked thereby inhibiting the flow of adhesive through the nozzle. As a result, in such a pressure-dependent system, the pressure at each nozzle and the subsequent flow rate of adhesive from each nozzle has been difficult to control and predict.

For example, one conventional technique which relies upon pressure for spraying the adhesive involves an apparatus having a plurality of nozzles which are connected to a manifold. Adhesive is supplied to the manifold and nozzles by a single large, central tank of molten adhesive. The tank of adhesive is pressurized to deliver the adhesive from the tank to the manifold and to the individual nozzles. The individual nozzles are then independently turned on and off to spray the adhesive. The amount of adhesive which is dispensed from the nozzles is dependent upon the pressure at the tank of adhesive, the length of the supply lines, the number of nozzles which are being operated at a given point in time and whether the nozzle are operating efficiently.

Another conventional technique which relies upon pressure for spraying adhesive is similar to the above technique except the adhesive is continuously supplied from the central tank to the manifold and nozzles by a pump. The pump is configured to continuously supply a flow of adhesive to the manifold. The manifold includes a means for recirculating the adhesive such that any unused adhesive may be recirculated back to the central tank of adhesive through a recirculation line. The pump generally runs continuously whether or not adhesive is being sprayed from the nozzles.

In such a configuration, the manifold includes a pair of valves for each nozzle to control the flow of adhesive to the respective nozzle. A first valve is operated to control the flow of adhesive to the recirculation line leading back to the tank of adhesive and a second valve is operated to control the flow of adhesive through the nozzle. The first valves in such a system may be pressure activated valves which will automatically open to recirculate the adhesive when a certain pressure is reached. In operation, the first valve is closed and the second valve is opened to allow adhesive to flow through the nozzle to spray the adhesive. The nozzles in the manifold may be operated independently, all together, or in selected groups. In such a configuration, the amount of adhesive which is dispensed from each nozzle depends upon the amount of adhesive which is supplied to the manifold, the number of nozzles which are being operated at a given point in time, the amount of adhesive being recirculated and whether the nozzles are operating efficiently.

Still another conventional technique for spraying adhesive is similar to the above techniques except that the recirculation line which allows adhesive to flow back to the supply tank is continuously maintained in an open position. In such a configuration, the amount of adhesive which is dispensed from the nozzles is again dependent upon the pressure variations in the system.

Other conventional techniques for spraying an adhesive on a moving web have relied upon volumetric displacement to deliver and spray the adhesive from a plurality of nozzles. In a volumetric displacement system, a predetermined volumetric flow rate of adhesive is delivered to each nozzle. One conventional technique which relies upon volumetric displacement for spraying the adhesive involves an apparatus having a plurality of nozzles. Adhesive is supplied to each nozzle by it's own pump which is connected to a single large, central tank of molten adhesive by a supply line. Each individual nozzle/pump combination includes a pair of valves that control the flow of adhesive. For example, one valve is positioned in the supply line leading from the tank of adhesive to the individual pump, and a second valve is positioned in the supply line leading from the pump to the respective nozzle. The pumps generally run continuously whether or not adhesive is being supplied from the tank. The nozzles may be operated independently, all together, or in selected groups. In operation, the valve between the tank and the pump is opened to allow adhesive to flow to the pump, and then the valve between the pump and the nozzle is opened to spray the adhesive.

Another conventional technique which relies upon volumetric displacement for spraying adhesive is similar to the above technique except that each nozzle is capable of being operated between an on position and an off position and each nozzle/pump combination includes a mechanism for recirculating the adhesive back to the tank of adhesive when the nozzle is operated in the off position. For example, a valve may be positioned in a recirculation line which is connected to the adhesive supply line extending between the individual pump and the respective nozzle. In operation, adhesive is continuously supplied from the pump to the nozzle. To spray the adhesive, the valve in the recirculation line is closed and the nozzle is subsequently turned to an on position. To stop the spray of adhesive, the nozzle is turned to an off position and the valve is subsequently opened to recirculate the adhesive.

Many of the conventional techniques for spraying adhesive, such as those described above have not been completely satisfactory. For example, in techniques which utilize pressure to supply adhesive to a manifold which includes a plurality of nozzles, it has been difficult to regulate the amount of adhesive which is sprayed from each individual nozzle as each nozzle is independently turned on and off. Typically, the adhesive has been supplied to the manifold at a constant pressure. As such, the mass flow rate of the adhesive through each nozzle has undesirably fluctuated as the number of operating nozzles has varied and the recirculation line has been opened and closed. For example, as the number of operating nozzles is decreased, the mass flow rate of the adhesive to the remaining nozzles will be increased due to the constant pressure applied to the manifold. As a result, the amount of adhesive sprayed from each nozzle and the corresponding pattern of the spray has undesirably varied as the number of operating nozzles has varied. In addition, the nozzle have frequently become either partially or totally obstructed which has also undesirably varied the amount of adhesive being sprayed from each nozzle.

Moreover, in the conventional techniques which have utilized a pair of valves to control the flow of adhesive, it has been difficult to provide an instantaneous spray of adhesive at the desired amount. For example, since both valves are required to be operated to supply adhesive to the nozzle, the adhesive has not been immediately supplied to the nozzle at the desired flow rate to provide the desired spray pattern of adhesive. Typically, the spray of adhesive from each nozzle as it is turned on has been less than the desired amount and the desired amount has not been reached until a period of time has lapsed. Such inconsistent amounts of adhesive have led to insufficient adhesion between the webs being bonded together. Control mechanisms have been utilized to provide a time delay between the opening of the valves in an attempt to provide the requisite flow of adhesive to the nozzle before it is opened. However, it has been difficult to accurately time the valves to instantaneously provide the desired pattern of adhesive at the desired amount. This problem has been particularly acute when attempting to intermittently spray the adhesive on a continuously moving web in a controlled, intermittent pattern.

The above-mentioned problems encountered in spraying an adhesive have been particularly evident and difficult to solve when compared to spraying other liquids, such as water, inks and the like, due to the relatively high viscosity of adhesives. Moreover, typical adhesive applications require a relatively low mass flow rate of adhesive which makes it increasingly difficult to regulate the amount of adhesive being sprayed on the moving web.

As a result, it remains desirable to provide an apparatus and method which are configured to instantaneously and accurately control the amount and spray pattern of an adhesive on a continuously moving web. In particular, it remains desirable to provide an adhesive spraying system which is capable of accurately and reliably spraying a predetermined volumetric flow of adhesive on a continuously moving web. In addition, it remains desirable to provide a plurality of nozzles, each of which is adapted to spray an independent, predetermined volumetric flow of adhesive and provide an almost instantaneous spray of adhesive in the desired amount and pattern as the nozzle is operated from an off position to an on position.

SUMMARY OF THE INVENTION

In response to the difficulties and problems discussed above, a new apparatus and method for spraying an adhesive have been discovered.

In one aspect, the present invention relates to an apparatus for spraying an adhesive in a selected pattern on a continuously moving web. The apparatus includes at least one nozzle which is connected to an adhesive supply line and configured to be operated between an on position and an off position. The apparatus also includes a metering mechanism which is configured to continuously supply a predetermined volumetric flow of the adhesive through the adhesive supply line to the nozzle. An adhesive divert line is connected to the adhesive supply line between the metering mechanism and the nozzle. A valve mechanism is operatively connected to the adhesive divert line and is configured to be operated in a closed position when the nozzle is operated in the on position and in an open position when the nozzle is operated in the off position to divert the volumetric flow of the adhesive from the nozzle when the nozzle is operated in the off position. A pressure regulating mechanism is operatively connected to the adhesive divert line between the nozzle and the valve mechanism for maintaining a back pressure at the nozzle when the nozzle is operated in the off position. The back pressure at the nozzle provides for a substantially instantaneous spray of the adhesive from the nozzle when the nozzle is operated from the off position to the on position to provide the selected pattern of the adhesive on the moving web.

In a particular embodiment, the apparatus includes a plurality of nozzles, each of which is connected to an independent adhesive supply line. In such a configuration, the metering mechanism continuously supplies an independent, volumetric flow of the adhesive through each of the adhesive supply lines to each of the nozzles. An adhesive divert line is connected to each adhesive supply line between the metering mechanism and each respective nozzle. A valve mechanism is connected to each adhesive divert line. A separate pressure regulating mechanism is connected to the adhesive divert line between each of the nozzles and the valve mechanisms to maintain a back pressure at each nozzle to provide the substantially instantaneous spray of adhesive from each nozzle.

In another aspect, the present invention concerns an apparatus for intermittently spraying a predetermined volumetric flow of adhesive from a nozzle in a selected pattern on a continuously moving web. The apparatus comprises a pressure regulating means for maintaining a back pressure at the nozzle when the nozzle is operated in an off position to provide a substantially instantaneous spray of the adhesive from the nozzle when the nozzle is operated from the off position to an on position to provide the selected pattern of the adhesive on the moving web.

In another aspect, the present invention concerns a method of spraying an adhesive in a selected pattern on a continuously moving web. The method comprises the steps of: (a) continuously supplying a predetermined volumetric flow of the adhesive through an adhesive supply line to at least one nozzle; (b) selectively operating the nozzle between an off position and an on position to spray the volumetric flow of the adhesive in the selected pattern on the moving web; (c) diverting the volumetric flow of the adhesive from the nozzle when the nozzle is operated in the off position; and (d) maintaining a back pressure at the nozzle when the nozzle is operated in the off position to provide a substantially instantaneous spray of the adhesive when the nozzle is operated from the off position to the on position.

In yet another aspect, the present invention concerns a composite material which comprises a first substrate web, a second substrate web and an adhesive which is located between the first substrate web and the second substrate web to join the substrate webs together. The adhesive is sprayed on at least one of the substrate webs by the method according to the present invention.

Accordingly, the different aspects of the present invention advantageously provide an apparatus and method for spraying an adhesive in any desired pattern and amount. In particular, the present invention is directed to an apparatus and method which can advantageously provide an instantaneous volumetric flow of adhesive from a nozzle in a predetermined amount as the nozzle is operated from an off position to an on position. The volumetric flow of adhesive which is sprayed on the moving web can be precisely controlled and does not vary as the other nozzles within the adhesive spraying system are independently operated between an on and an off position. As a result, the present invention provides an apparatus and method which provide a volumetric spray of adhesive which can be more accurately and reliably controlled to provide any desired pattern on a moving web. Accordingly, materials which are adhesively bonded together using the different aspects of the present invention have a more consistent level of adhesion which results in improved performance.

BRIEF DESCRIPTION OF THE DRAWINGS

The present invention will be more fully understood and further advantages will become apparent when reference is made to the following detailed description of the invention and the accompanying drawings wherein like numerals represent like elements. The drawings are merely representative and are not intended to limit the scope of the appended claims.

DESCRIPTION OF THE INVENTION

The present invention relates to apparatus and methods for accurately spraying an adhesive on a continuously moving web in a desired pattern. The apparatus and methods are particularly useful for spraying adhesive to adhesively bond different components of a disposable absorbent article, such as the outer cover and bodyside liner of a disposable diaper, together. It is readily apparent, however, that the apparatus and methods of the present invention would also be suitable for spraying adhesive to adhesively bond any component to any moving web or absorbent article such as an adult incontinence product, feminine care product, training pant and the like. For the purpose of the present description, the various aspects of the apparatus and methods of the present invention will be described as being used to spray an adhesive on a continuously moving web.

The different aspects of the present invention can be used to spray the adhesive in any desired pattern on the continuous moving web. As used herein, the term "spray" and variations thereof refers to the flow of adhesive which results when the adhesive is dispensed from a flow control device such as a nozzle, an orifice or the like. For example, the term "spray" can refer to a plurality of atomized droplets, a plurality of discrete fibers, a series of continuous filaments which may be dispensed in a linear or swirled configuration, or any combination thereof. The spray of adhesive can also be manipulated by directing air flows at the stream of adhesive leaving the flow control device.

As used herein the term "pattern" refers to any geometric or non-geometric configuration which can include, among others, a series of connected or unconnected lines or curves, a series of parallel or non-parallel or intersecting lines or curves, a series of linear or curvilinear lines, a random array of discontinuous lines or droplets, or any combination thereof. The pattern may also include intermittent, repeating or non-repeating configurations, or any combination thereof. Examples of suitable patterns will be described hereinafter.

As used herein, the term "nozzle" refers to any flow control device which is configured to accept a flow of adhesive and dispense the adhesive therefrom in a controlled manner. Typically, such nozzles are configured to be operated between an on position and an off position and are further configured to dispense the adhesive when operated in the on position. Examples of suitable nozzles include a simple orifice, an air actuated nozzle and a pressure actuated nozzle as are well known to those skilled in the art.

Figure 1:
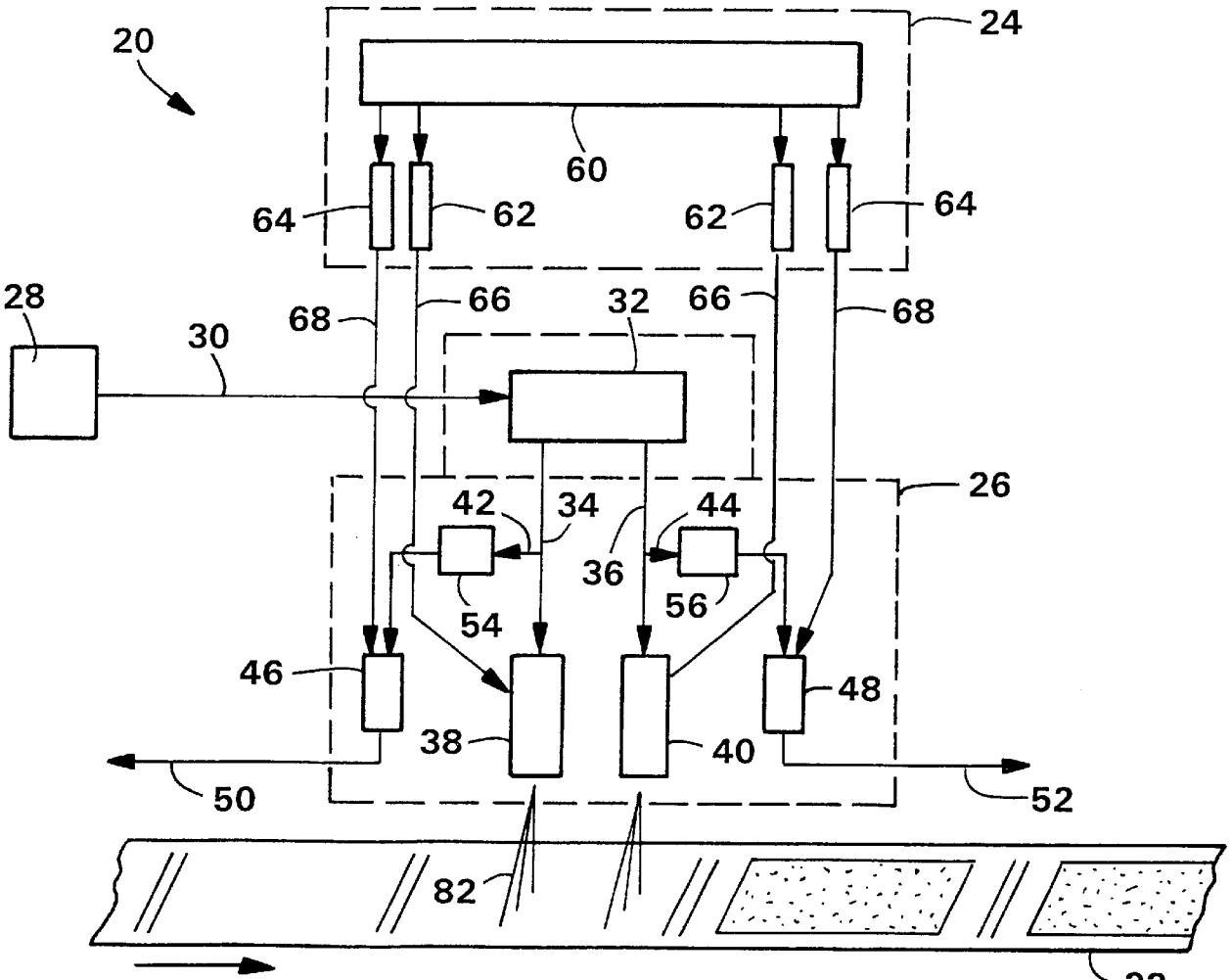
FIG. 1 representatively shows a schematic diagram of one example of a method and apparatus according to the present invention.
Figure 2:
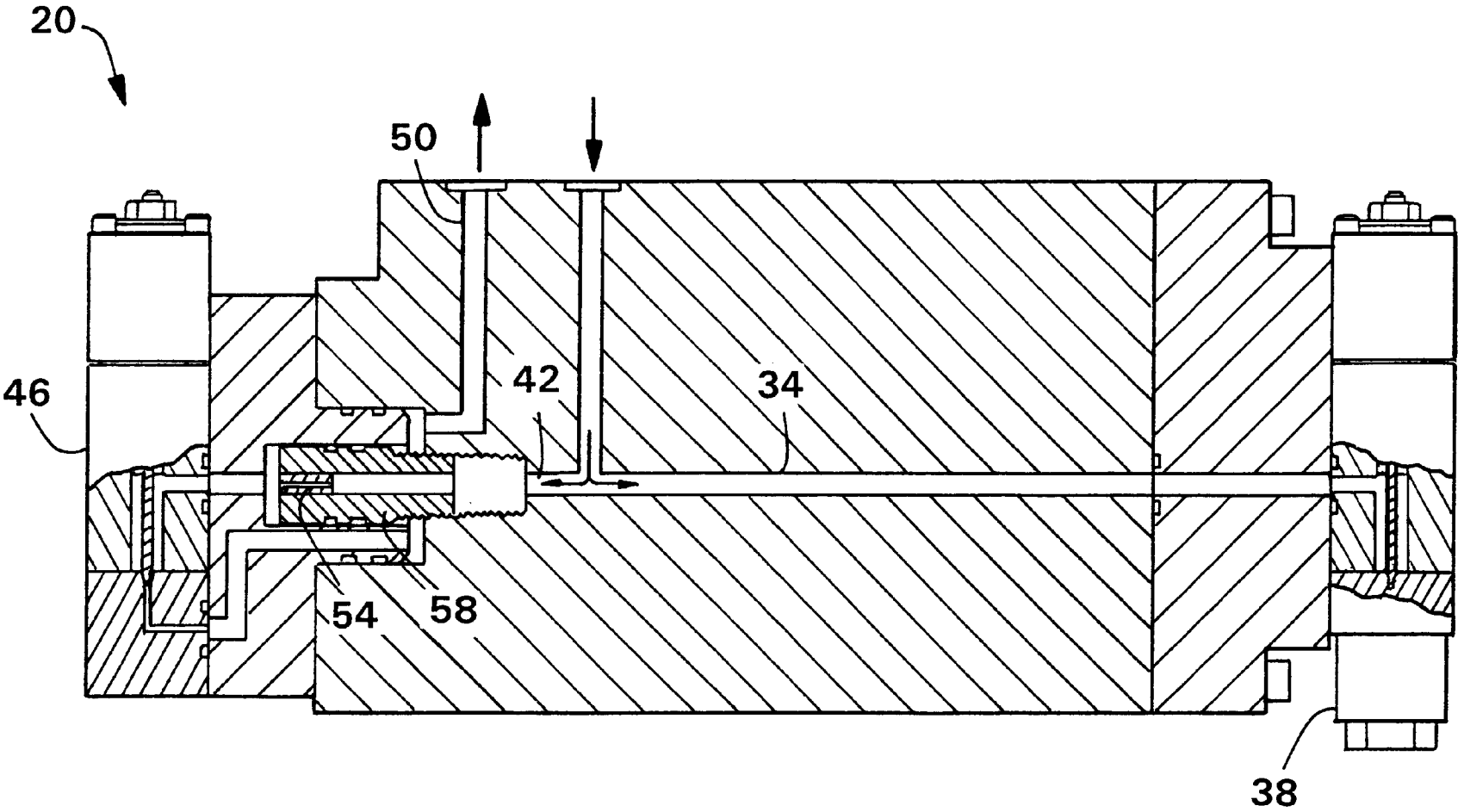
FIG. 2 representatively shows a partially cut away side elevational view of another example of a method and apparatus according to the present invention.

The present invention can best be understood by reference to the drawings wherein like numerals represent like elements. FIG. 1 representatively illustrates a schematic diagram of an apparatus, generally indicated at 20, and method for spraying an adhesive on a continuously moving web 22. FIG. 2 representatively illustrates a partially cut away side elevational view of one example of the apparatus 20 illustrated in FIG. 1. The apparatus 20 may include a programmable control system 24 which is operatively connected to a flow control system 26. The combination of the programmable control system 24 and the flow control system 26 are configured to control the delivery of an adhesive, such as a hot melt adhesive which is in liquid form, to the moving web 22. The apparatus may also include a position sensing system which is configured to sense a position of the moving web 22 and, in response thereto, generate a signal that is sent to the programmable control system 24.

As representatively illustrated in FIG. 1, the continuously moving web 22 may be supplied by any means known to those skilled in the art, such as known conveyor systems. The continuously moving web 22 can include any type of layer or web of material, such as films of thermoplastic material, nonwoven webs of thermoplastic material or a combination of thermoplastic material and natural fibers such as wood pulp fluff fibers, woven webs which may include strands of thermoplastic material, natural material such as threads of cotton and the like, laminate materials, or combinations thereof. As will be described hereinafter in more specific terms, the adhesive is sprayed on the continuously moving web 22 in a specific design or pattern for subsequent placement of or bonding to another material.

The programmable control system 24 of the present invention is configured to send signals to the flow control system 26 which, in response thereto, is configured to initiate a spray of adhesive at the correct time to provide the desired pattern of adhesive on the moving web 22. As representatively illustrated in FIG. 1, the flow control system 26 includes an adhesive source 28 which is configured to deliver an adhesive through an adhesive supply line 30 to a metering mechanism 32. The adhesive can be delivered to the metering mechanism 32 by any means known to those skilled in the art, such as by the use of a pump.

The metering mechanism 32 is configured to continuously supply at least one independent, volumetric flow of adhesive to a respective nozzle. As used herein, the term "volumetric flow" refers to a flow of adhesive which has a predetermined volumetric flow rate. Such a "volumetric flow" may be provided by a positive displacement metering pump which is configured to supply a specific volumetric flow which is independent of the manner in which the adhesive is supplied to the metering mechanism 32. As a result, for an adhesive which is at a given density, the metering mechanism 32 of the present invention is configured to provide an independent, predetermined mass flow rate of adhesive to each nozzle which provides improved adhesion between the materials being bonded together.

As discussed above, in conventional adhesive systems which utilize pressure to provide a flow of adhesive, the volumetric flow rate and mass flow rate of the adhesive has undesirably varied depending upon many factors including the pressure at which the adhesive is being supplied, the size and number of nozzles, the length of the adhesive supply lines, the number of nozzles being operated at a given point in time and whether the nozzles are operating efficiently. Such a non-volumetric flow of adhesive has undesirably resulted in variations of the pattern of adhesive which has been sprayed on the moving web. The different aspects of the present invention avoid this undesirable result by providing an independent, volumetric flow of adhesive to each nozzle.

The metering mechanism 32 of the present invention may be configured to supply a single, volumetric flow of adhesive to one nozzle or an independent, volumetric flow of adhesive to each of a plurality of nozzles depending upon the number of nozzles required to provide the desired pattern of adhesive on the moving web 22. For example, as representatively illustrated in FIGS. 1 and 2, the metering mechanism 32 may be configured to continuously supply an independent volumetric flow of adhesive through adhesive supply lines 34 and 36 to respective nozzles 38 and 40. The adhesive supply lines 34 and 36 are connected to the adhesive inlet on each respective nozzle 38 and 40. As such, each nozzle 38 and 40 is supplied with its own volumetric flow of adhesive. In such a configuration, the metering mechanism 32 is configured to continuously supply a volumetric flow of adhesive to each nozzle 38 and 40 at a predetermined volumetric flow rate which is independent of and unaffected by the operation of the other nozzle. Each nozzle 38 and 40 is configured to spray substantially the entire volumetric flow of adhesive supplied to it when operated in the on position.

Figure 3:
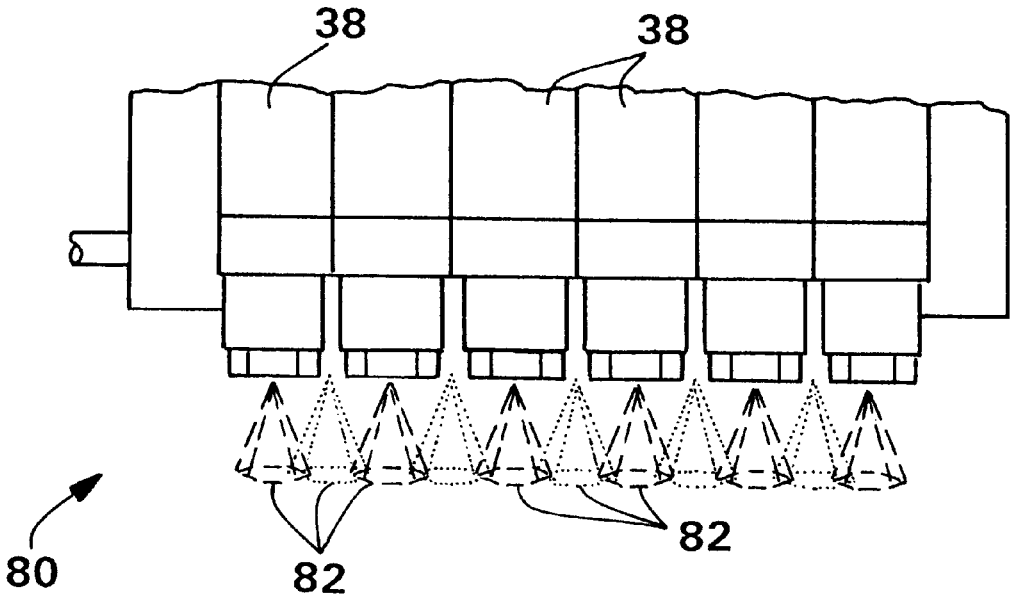
FIG. 3 representatively shows a partial side elevational view of a manifold which includes a plurality of nozzles according to the present invention.
Figure 4:
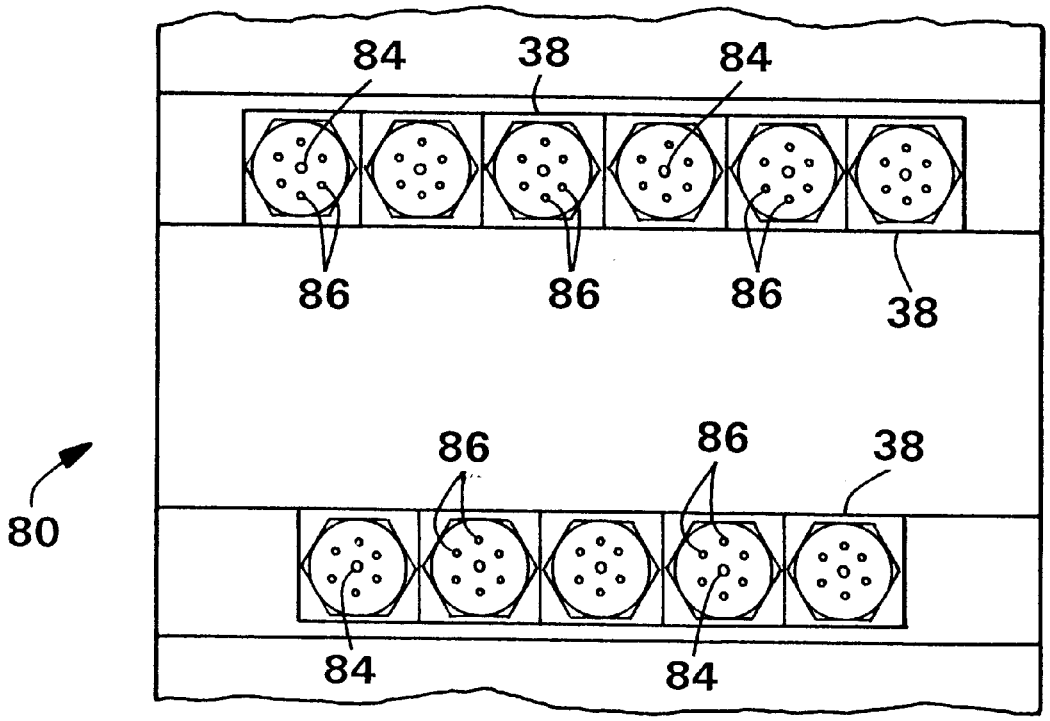
FIG. 4 representatively shows a plan view of the nozzles representatively illustrated in FIG. 3.

In one particular embodiment, the metering mechanism 32 may be configured to supply an independent, volumetric flow of adhesive to each of a plurality of nozzles, such as the bank of nozzles 80 representatively illustrated in FIGS. 3 and 4. The bank of nozzles 80 may include any number of nozzles 38 which are arranged to provide the desired pattern of adhesive on the moving web. For example, as representatively illustrated in FIGS. 3 and 4, the nozzles 38 may be arranged in one or more rows such that the spray of adhesive 82 from each nozzle 38 is configured to overlap the spray of adhesive 82 from an adjacent nozzle in the same row or a nozzle in another row. By offsetting the nozzles 38 by the appropriate distance, an uninterrupted spray of adhesive in the cross machine direction can be sprayed in any selected pattern on the continuously moving web 22.

The metering mechanism 32 of the different aspects of the present invention may include any device which is capable of providing an independent, volumetric flow of adhesive to each of a desired number of nozzles. One skilled in the art will further recognize that more than one metering mechanism may be used in the present invention to supply each of the desired number of nozzles with its own volumetric flow of adhesive. A suitable device to provide the metering mechanism 32 may include a positive displacement metering pump which is commercially available from May Coating Technologies, Acumeter Division, a business having offices located in Holliston, Mass., under the trade designation No. 19539. The metering mechanism 32 may include any other piston pump or gear pump which are well known to those skilled in the art. In a particular embodiment, the metering mechanism 32 may be configured to supply from 1 to about 8 independent, volumetric flows of adhesive to an equal number of nozzles. The independent volumetric flows of adhesive may also be obtained by incorporating multiple metering mechanisms.

The metering mechanism 32 of the present invention may be configured to supply any desired volumetric flow rate of adhesive to each nozzle. For example, the metering mechanism 32 may be configured to provide a predetermined volumetric flow rate of from about 1 to about 1000 cubic centimeters per minute and desirably from about 30 to about 180 cubic centimeters of adhesive per minute to each nozzle. The metering mechanism 32 may be configured to provide either a constant or a variable volumetric flow rate of adhesive to each nozzle. For example, if the metering mechanism 32 is a positive displacement metering pump, the speed of the pump may be controlled to vary the volumetric flow rate of adhesive to the nozzles. In a particular embodiment, the metering mechanism 32 is configured to provide a substantially constant volumetric flow rate of adhesive to each nozzle to provide a more accurate control of the pattern of adhesive sprayed on the moving web.

Each nozzle 38 and 40 as representatively illustrated in FIGS. 1–4, can be any device which is capable of providing the desired pattern of adhesive on the moving web 22. For example, one suitable nozzle is commercially available from Nordson Corporation, a business having offices located in Duluth, Ga., under the trade designation Model No. 144906. Another suitable nozzle for use in the present invention is obtainable from ITW Dynatec Co. of Hendersonville, Tenn., under the trade designation number 057B1639, I.D. #A3. Such nozzles are typically configured to be operated between an on position and an off position to control the spray of adhesive from the nozzles. When operated in the on position, each nozzle of the present invention may be configured to spray substantially the entire volumetric flow of adhesive which is independently supplied to it to more accurately control the amount and pattern of the adhesive on the moving web.

The nozzles 38 and 40 of the present invention may further be configured to include air streams which can be directed to provide a desired patterns in the spray of adhesive being dispensed from each nozzle. For example, as representatively illustrated in FIGS. 3 and 4, each nozzle may include a series of air openings 86 surrounding the nozzle orifice 84 which are configured to direct air streams at the adhesive as it is dispensed. Such air streams can provide a desired adhesive spray pattern, such as a pattern of swirls of adhesive.

The flow control system 26 of the different aspects of the present invention further includes at least one valve mechanism for diverting the flow of adhesive from each nozzle when the nozzle is operated in the off position. For example, as representatively illustrated in FIGS. 1 and 2, the flow control system 26 of the present invention may include an adhesive divert line 42 and 44 which is connected to each adhesive supply line 34 and 36 between the metering mechanism 32 and the respective nozzle 38 and 40. A valve mechanism 46 and 48 which is configured to be operated between an open position and a closed position is operatively connected to each adhesive divert line 42 and 44. In use, each valve mechanism 46 and 48 is configured to be operated in a closed position when the respective nozzle 38 and 40 is operated in the on position and in an open position when the respective nozzle 38 and 40 is operated in the off position. As such, each valve mechanism 46 and 48 is configured to divert the volumetric flow of adhesive from each respective nozzle 38 and 40 when the nozzle is operated in the off position. Accordingly, in a particular embodiment, the entire volumetric flow of adhesive is either sprayed from the respective nozzle or diverted from the nozzle depending upon whether the nozzle is operated in the on position or the off position. As a result, the flow of adhesive from each nozzle of the present invention can be more reliably controlled to provide the desired pattern of adhesive on the moving web.

Each valve mechanism 46 and 48 may include any device which is capable of being operated between a closed position and an open position to selectively divert the volumetric flow of adhesive from the respective nozzle 38 and 40. For example, each valve mechanism may include a pressure relief valve which is commercially available from Circle Seal Controls, a business having offices located in Anaheim, Calif., under the trade designation HP-532B-2M-450. Each valve mechanism may otherwise include a return module which is commercially available from Nordson Corporation under the trade designation Model No. 157831. Alternatively, in a particular embodiment, each valve mechanism 46 and 48 may include another nozzle such as those commercially available from Nordson Corporation under the trade designation Model No. 144906. When the valve mechanism is a nozzle, the valve mechanism may be configured to provide another spray of adhesive on the moving web when operated in the open position. In such a configuration, the flow control system 26 is configured to supply the independent, volumetric flow of adhesive to either the main nozzle 38 or 40 or the respective secondary nozzle 46 or 48.

The flow control system 26 of the different aspects of the present invention further includes at least one pressure regulating mechanism which is configured to maintain a minimum back pressure at the nozzle. For example, as representatively illustrated in FIGS. 1 and 2, the flow control system 26 may include a pressure regulating mechanism 54 and 56 connected to each adhesive divert line 42 and 44 between each nozzle 38 and 40 and valve mechanism 46 and 48, respectively. The pressure regulating mechanism 54 and 56 is configured to maintain a certain minimum back pressure at each respective nozzle 38 and 40 such that the desired amount of adhesive is sprayed from the nozzle substantially instantaneously when the nozzle 38 and 40 is operated from the off position to the on position. Such an instantaneous spray can be more precisely controlled to provide the selected pattern of adhesive on the moving web 22 in the desired amount.

Generally, in conventional adhesive spraying systems, when a nozzle is operated from the on position to the off position and the adhesive is diverted from the nozzle, the pressure in the adhesive supply line at the nozzle inlet immediately drops. In such a configuration, the amount of adhesive sprayed from the nozzle at the instant it is operated from the off to the on position may vary and is generally undeterminable. However, the pressure regulating mechanism 54 and 56 according to the present invention avoids this problem by maintaining a minimum back pressure at each respective nozzle 38 and 40 when the nozzle is operated in the off position such that the desired amount of adhesive is instantaneously sprayed from the nozzle when it is operated from the off to the on position.

The pressure regulating mechanism 54 and 56 of the present invention may be configured to maintain any desired minimum back pressure to provide the desired instantaneous spray of adhesive. In a particular embodiment, the pressure regulating mechanism 54 and 56 may be configured to maintain a back pressure of at least about 344,750 Pascals (50 psi), desirably at least about 3,447,500 Pascals (500 psi) and, even more desirably, at least about 6,895,000 Pascals (1000 psi) at the nozzle for improved performance. Suitable pressure regulating mechanisms are configured to provide a back pressure of from about 344,750 to about 10,342,500 Pascals (50 to about 1500 psi) and desirably from about 2,758,000 to about 5,516,000 Pascals (400 to about 800 psi) at the nozzle to provide the desired instantaneous spray of adhesive.

In a particular embodiment, the pressure regulating mechanism 54 and 56, as representatively illustrated in FIGS. 1 and 2, is configured to maintain a sufficient back pressure at the nozzle such that the adhesive is dispensed from the nozzle at a substantially constant volumetric flow rate throughout the entire period in which the nozzle is operated in the on position. Desirably, the pressure regulating mechanism 54 and 56 is also configured to provide a substantially constant back pressure at each nozzle 38 and 40 to ensure that the desired amount of adhesive is consistently being sprayed instantaneously as the nozzle is operated from the off position to the on position. The pressure regulating mechanism 54 and 56 of the present invention may alternatively be configured to provide a variable back pressure at each nozzle 38 and 40 which can be independently controlled to vary the amount of adhesive which is sprayed out of each nozzle 38 and 40 at the instant when the nozzle is operated from the off position to the on position.

Accordingly, the pressure regulating mechanism 54 and 56 can be configured to maintain sufficient back pressure at the nozzle to ensure that any desired volumetric flow rate of adhesive is dispensed from the nozzle at substantially the instant it is turned on. As a result, the apparatus and methods of the different aspects of the present invention provide a more effective control of the pattern of adhesive which is sprayed on the moving web. Moreover, since a substantially instantaneous flow of adhesive is provided to each nozzle, it is not necessary to vary the timing between the operation of the valve mechanism 46 and 48 and the respective nozzle 38 and 40. As such, each valve mechanism 46 and 58 can be operated between the open position and the closed position and the respective nozzle 38 and 40 can be operated between the off position and the on position simultaneously to provide the instantaneous spray of adhesive from the respective nozzle.

Further, the pressure regulating mechanism 54 and 56 of the present invention can provide a substantially instantaneous flow of adhesive from the respective nozzle 38 and 40 even when the desired volumetric flow rate of the adhesive is relatively low. For example, in a particular embodiment, each pressure regulating mechanism 54 and 56 may be configured to provide sufficient back pressure at the respective nozzle 38 and 40 to provide an instantaneous flow of adhesive from the nozzle at a volumetric flow rate of no more than 200 cubic centimeters per minute, desirably no more than 100 cubic centimeters per minute and even more desirably no more than 50 cubic centimeters per minute.

The pressure regulating mechanism 54 and 56 of the different aspects of the present invention may include any device which is capable of maintaining the desired back pressure at the nozzle 38 and 40 to provide the desired instantaneous spray of adhesive when the nozzle is operated from the off position to the on position. For example, the pressure regulating mechanism may include a restrictor which is commercially available from May Coating Technologies, Acumeter Division, a business having offices located in Holliston, Mass., under the trade designation C-3639-6. Alternatively, the pressure regulating mechanism may be a pressure relief valve or a pressure control valve as are well known to those skilled in the art. An example of a pressure regulating mechanism which can provide a predetermined variable back pressure at the nozzle is an adjustable pressure control valve.

In a particular embodiment, as representatively illustrated in FIG. 2, the pressure regulating mechanism 54 is a restrictor which is inserted in the respective adhesive divert line 42 and 44. Typically, the restrictor is a flat disk or threaded rod which includes a restrictor orifice through which the adhesive flows. The size of the restrictor orifice will be determined by the back pressure which is desired at the nozzle. For example, the restrictor may have a restrictor orifice which defines a restrictor diameter of from about 0.25 to about 2.03 millimeters and desirably from about 0.46 to about 0.64 millimeters. In a particularly desirable configuration, the restrictor diameter is equal to or less than a diameter of the nozzle orifice in the respective nozzle to provide improved performance. As representatively illustrated in FIG. 2, the restrictor 54 may be located in a plug 58 which is located in the adhesive divert line 42. In such a configuration, the restrictor 54 may be easily removed and a restrictor having a different diameter may be inserted depending upon the desired back pressure at the nozzle.

The programmable control mechanism 24 of the different aspects of the present invention is configured to independently control the operation of each nozzle in the flow control system 26 to provide the desired pattern of adhesive on the moving web 22. For example, as representatively illustrated in FIG. 1, the programmable control mechanism 24 may include a programmable controller 60 which is configured to send signals to solenoids 62 and 64. The solenoids 62 and 64, in turn, may be configured to provide an air flow through air lines 66 and 68 to control the operation of each nozzle 38 and 40 and each valve mechanism 46 and 48, respectively. The solenoids 62 and 64 can be any solenoid suitable for operation with the invention as are well known to those skilled in the art. One suitable solenoid is commercially available from MAC Valves, Inc. of Luixom, Mich., under the Model No. 45AL00DDAJ1KG.

Referring to FIG. 1, each solenoid 62 and 64 may be a three-way valve that is operable between an air-inlet position, an air-outlet position, and an exhaust position. Air under pressure is supplied to each solenoid by any suitable means, such as by a compressor. In use, the programmable controller 60 sends a signal to the solenoids 62 and 64 which, in turn, are operated to supply pressurized air to each nozzle 38 and 40 and each valve mechanism 46 and 48. The pressurized air then operates the respective nozzle between an on position and an off position and the respective valve mechanism between on open and a closed position. In a particular embodiment, such operations are configured to occur simultaneously. In an alternative configuration, a single 4-way solenoid may simultaneously control each nozzle/valve mechanism combination.

The programmable controller 60 is any suitable controller which is capable of sending the appropriate signals to the solenoids 62 and 64. One example of a suitable programmable controller is commercially available from Allen-Bradley of Milwaukee, Wis., and is identified as a PLC 5/25 programmable logic controller. The programmable controller 60 may be programmed to receive a position signal from a position sensing system to determine whether the pattern of adhesive is correctly positioned on the continuously moving web 22. If the position of the spray pattern does not meet the criteria of the programmed instruction in the controller 60, the controller 60 will generate a correction signal in response to the adhesive pattern being out of position, and send the correction signal to the solenoids 62 and 64. Alternatively, the programmable controller 60 may be manually programmed to generate and send the correction signal to the solenoids 62 and 64. The operation of the solenoids 62 and 64 can be controlled to adjust the operation of the nozzles 38 and 40 and valve mechanism 46 and 48 to properly position a subsequent adhesive spray pattern on the moving web 22. Suitable control means to provide such signals from the programmable controller 60 to the solenoids 62 and 64 are well known to those skilled in the art.

In response to the air flows from the solenoids 62 and 64, the nozzles 38 and 40 are independently operated to spray the adhesive in the desired pattern on the moving web 22. Since each pressure regulating mechanism 54 and 56 is configured to maintain a back pressure at each nozzle 38 and 40, respectively, the solenoids 62 and 64 which operate the nozzle and the respective valve mechanism may be operated simultaneously to provide improved control of the adhesive spray. As such, it is not necessary to delay the timing of the operation of the valve mechanism and nozzles in the present invention as is required in many conventional techniques of spraying adhesive.

The position sensing system may be any suitable system which provides the desired signals to the programmable controller 60. Such systems are well known to those skilled in the art. For example, a suitable position sensing system may include a detector which is configured to optically sense the position of the adhesive pattern and send a position signal to the programmable controller 60. The moving web 22 which is conveyed to the flow control system 26 may also include a plurality of references which can be sensed by the position sensing system. The references may include some type of mark, signal, or location that can be sensed, measured, or the like by the position sensing system. For example, if the moving web 22 includes a series of interconnected diaper articles, the reference may be a specific component, such as the waist elastic, on each article or the reference may be generated by the equipment which is used to apply the components. Suitable mechanisms to provide the desired signal to the programmable control center 24 to initiate the spray of adhesive are known to those skilled in the art. For example, a rotary position transducer may be suitably connected to a separate rotating component, such as a conveyor roller, and configured to produce a position signal which is converted to digital format for processing by the programmable control center 24. The continuously moving web 22 may also be treated to provide the references, such as with different colors, magnetic marks, and the like. Alternatively, the position sensing system may be a manual system in which measurements are made on the finished product and corrections are manually programmed into the programmable controller.

In use, the programmable control system 24 is configured to receive signals from the position sensing system regarding the position of the continuously moving web 22 and, in response thereto, send signals to the flow control system 26 to initiate the spray of adhesive at the correct time and the correct position. Each nozzle may then be independently operated at a preprogrammed time or position to apply the spray of adhesive at a prescribed location on the moving web 22.

Because each nozzle 38 and 40 has its own pressure regulating mechanism 54 and 56, and is supplied by its own independent volumetric flow of adhesive, each nozzle can be quickly operated independently of the other nozzles to provide a substantially instantaneous initiation and termination of the spray of adhesive. Furthermore, because each nozzle has its own volumetric flow of adhesive, the turning on or off of more or fewer nozzles does not affect the volumetric flow rate of the adhesive delivered to each nozzle. As a result, a predetermined volumetric flow of adhesive can be dispensed from each nozzle to more accurately provide the pattern of adhesive on the moving web 22 in the desired amount.

After the pattern of adhesive has been sprayed on the moving web 22 by the different aspects of the present invention, the web may be further processed in a variety of ways. For example, the continuously moving web 22 may be contacted by a second substrate web, such as a nonwoven layer, between a pair of nip rolls to adhesively join the two substrate webs together. Thereafter, this composite material may be used in a variety of ways such as in the construction of disposable absorbent articles such as diapers, incontinent articles, training pants, feminine care articles and the like. Alternatively, the different aspects of the present invention may be used to adhesively join separate components, such as discrete elastic segments, to the continuously moving web 22.

Specific examples of disposable diapers on which the apparatus and method of the present invention may be utilized are disclosed in the following U.S. patents and U.S. patent applications: U.S. Pat. No. 4,798,603 issued Jan. 17, 1989, to Meyer et al.; U.S. Pat. No. 5,176,668 issued Jan. 5, 1993, to Bernardin; U.S. Pat. No. 5,176,672 issued Jan. 5, 1993, to Bruemmer et al.; U.S. Pat. No. 5,192,606 issued Mar. 9, 1993, to Proxmire et al., and commonly assigned U.S. patent application Ser. No. 08/096,654 filed Jul. 22, 1993, in the name of Hanson et al.

The pattern of adhesive on the moving web 22 can be moved, as viewed in FIG. 1, in the machine direction, the cross machine direction, or lengthened or narrowed, or any combination thereof, by programming the programmable controller 60 with the appropriate instructions. Similarly, the pattern of adhesive can have its design changed, for example, from a rectangular design to an hourglass design, or from a design of non-continuous to continuous lines, or any combination as earlier described.

Figure 5:
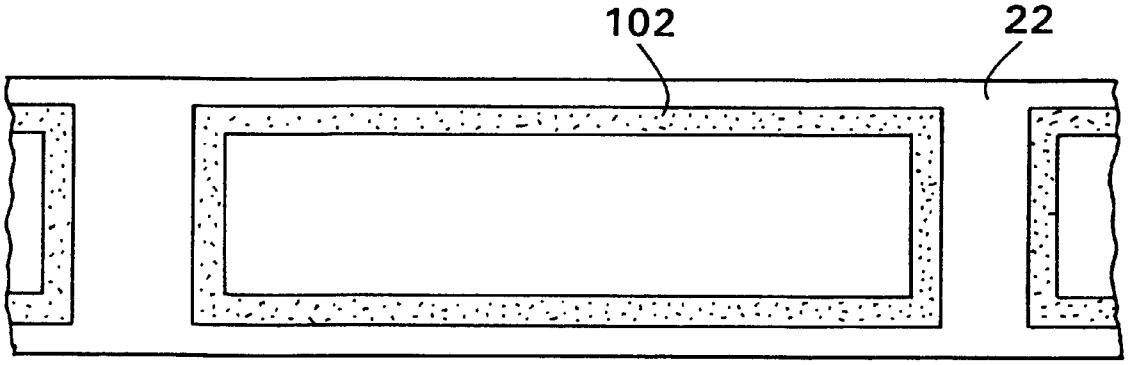
FIG. 5 representatively shows a top plan view of one example of a pattern of adhesive according to the present invention.
Figure 6:
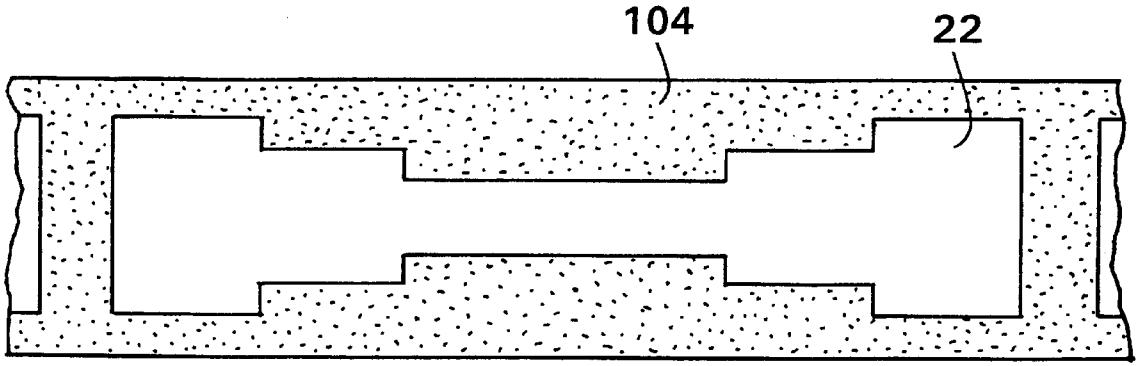
FIG. 6 representatively shows a top plan view of another example of a pattern of adhesive according to the present invention.

As mentioned earlier, the adhesive can be sprayed in any number of desired patterns by appropriately programming the different aspects of the present invention. FIGS. 5 and 6 representatively illustrate a web 22 which has two different patterns of adhesive thereon 102 and 104 which were sprayed on according to the apparatus and methods of the present invention. The different patterns of adhesive can be sprayed by appropriately programming the programmable controller 60 to control the solenoids to turn the nozzles on and off as desired.

While the invention has been described in detail with respect to specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and any equivalents thereto.

What is claimed is:

1. A method of spraying an adhesive in a selected pattern on a continuously moving web comprising the steps of:

(a) continuously supplying a predetermined volumetric flow of said adhesive through an adhesive supply line to a nozzle;

(b) selectively operating said nozzle between an off position and an on position to spray said volumetric flow of said adhesive in said selected pattern on said moving web wherein substantially said entire volumetric flow of said adhesive is sprayed from said nozzle when said nozzle is operated in said on position;

(c) diverting said volumetric flow of said adhesive from said nozzle through an adhesive divert line when said nozzle is operated in said off position by operating a valve means from a closed position to an open position when said nozzle is operated from said on position to said off position; and (d) maintaining a back pressure of at least about 344,750 Pascals (50 psi) at said nozzle when said nozzle is operated in said off position to provide a substantially instantaneous spray of said adhesive when said nozzle is operated from said off position to said on position.

2. The method according to claim 1 wherein said adhesive is continuously supplied to said nozzle at a substantially constant volumetric flow rate.

3. The method according to claim 1 wherein said adhesive is continuously supplied to said nozzle at a predetermined, variable volumetric flow rate.

4. The method according to claim 1 wherein said adhesive is continuously supplied to said nozzle at a volumetric flow rate of no more than 200 cubic centimeters per minute.

5. The method according to claim 1 wherein said valve means is operatively connected to said adhesive divert line which is connected to said adhesive supply line between a metering means and said nozzle.

6. The method according to claim 5 and further comprising the step of simultaneously operating said valve means from said open position to said closed position as said nozzle is operated from said off position to said on position to provide said instantaneous spray of said adhesive from said nozzle.

7. The method according to claim 1 wherein said step of maintaining said back pressure includes the step of providing a pressure regulating means which is operatively connected to said adhesive divert line between said nozzle and said valve means to maintain said back pressure at said nozzle when said nozzle is operated in said off position.

8. The method according to claim 7 wherein said pressure regulating means is a restrictor.

9. The method according to claim 8 wherein said restrictor includes a restrictor orifice which defines a restrictor diameter and said nozzle includes a nozzle orifice which defines a nozzle diameter and wherein said restrictor diameter is equal to or less than said nozzle diameter.

10. The method according to claim 1 wherein said back pressure is maintained at a substantially constant pressure.

11. The method according to claim 1 wherein said back pressure is maintained at a predetermined, variable pressure.

12. The method according to claim 1 wherein said selected pattern of said adhesive on said moving web is an intermittent pattern.

13. A method of spraying an adhesive in a selected pattern on a continuously moving web comprising the steps of:

(a) continuously supplying an independent, predetermined volumetric flow of said adhesive to each of a plurality of nozzles;

(b) independently operating each of said nozzles between an off position and an on position to spray said adhesive in said selected pattern on said moving web wherein substantially said entire independent volumetric flow of said adhesive to a respective one of said nozzles is sprayed from said respective nozzle when said nozzle is operated in said on position;

(c) selectively diverting said independent volumetric flow of said adhesive from each of said nozzles through a respective adhesive divert line when said respective nozzle is operated in said off position by operating a respective valve means from a closed position to an open position when said respective nozzle is operated from said on position to said off position; and (d) independently maintaining a back pressure of at least about 344,750 Pascals (50 psi) at each of said nozzles when said nozzle is operated in said off position to provide a substantially instantaneous spray of said adhesive when said nozzle is operated from said off position to said on position.

14. The method according to claim 13 wherein said predetermined volumetric flow of said adhesive is independently supplied to each of said nozzles at a substantially constant volumetric flow rate.

* * * * *